US006179410B1

(12) United States Patent
Kishima et al.

(10) Patent No.: US 6,179,410 B1
(45) **Date of Patent: *Jan. 30, 2001**

(54) PRINTER

(75) Inventors: Koichiro Kishima; Toshio Fukuda, both of Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/952,911

(22) PCT Filed: Mar. 21, 1997

(86) PCT No.: PCT/JP97/00947

§ 371 Date: Nov. 17, 1997

§ 102(e) Date: Nov. 17, 1997

(87) PCT Pub. No.: WO97/35724

PCT Pub. Date: Oct. 2, 1997

(30) Foreign Application Priority Data

Mar. 22, 1996 (JP) ..... 8-066826

(51) Int. Cl.[7] ..... B41J 2/135
(52) U.S. Cl. ..... 347/45
(58) Field of Search ..... 347/45, 47, 96, 347/98

(56) References Cited

U.S. PATENT DOCUMENTS 4,017,869 4/1977 Meyer et al. .
5,212,496 * 5/1993 Badesha et al. ..... 347/45
5,286,280 * 2/1994 Chiou ..... 95/45
5,365,255 * 11/1994 Inoue et al. ..... 347/45
5,728,473 * 3/1998 Inoue et al. ..... 428/448
5,747,625 * 5/1998 Furukawa et al. ..... 528/26
5,825,379 * 10/1998 Kagami ..... 347/20
5,980,014 * 11/1999 Kagami ..... 347/15

FOREIGN PATENT DOCUMENTS

3501905 * 12/1985 (DE) .
0 739 742 A2 3/1996 (EP) .
4-045950 2/1992 (JP) .
8-034119 2/1996 (JP) .
8-048039 2/1996 (JP) .

* cited by examiner

*Primary Examiner*—John Barlow
*Assistant Examiner*—Charles W. Stewart, Jr.
(74) *Attorney, Agent, or Firm*—Hill & Simpson

(57) ABSTRACT

A printer comprising a printing head for discharging ink alone or ink and diluent according to the present invention employs a polyimide polymer at least around nozzle opening (s) on the nozzle opening side of the printing head so as to enable to form a recorded image of a high resolution as well as to enhance the productivity. It is preferable that the polyimide polymer have a coefficient of water absorption as 0.4 (%) or below when dipped in water of 23 (°C.) for 24 hours. Furthermore, it is preferable that the printing head excluding the portion made from the polyimide polymer be made from polysulfone, polyethersulfone, or a polyimide polymer having a coefficient of water absorption as 1.0 (%) or above when dipped in water of 23 (°C.) for 24 hours. Moreover, it is preferable that nozzles are formed by ablation processing using eximer laser.

17 Claims, 19 Drawing Sheets

PRINTER

FIELD OF THE INVENTION

The present invention relates to a printer for discharging a discharge medium and a printer for mixing and discharging a quantitative medium and a discharge medium, and more particularly, to a printer capable of forming an image of a high resolution as well as enhancing the productivity.

BACKGROUND ART

In recent years, especially in business offices, "desktop publishing", i.e., document creation using a computer is widely spread, and a demand has been increased recently for outputting not only characters and graphics but also a color natural image such as a photograph together with characters and graphics. In order to answer such a demand, it has become necessary to print out a natural image of high quality requiring reproduction of halftones.

Moreover, a so-called on-demand type printer is being rapidly spread. This is a printer, in which an ink droplet is discharged from a nozzle and applied to a medium such as a paper and a film only when necessary during a printing. Such a printer has a possibility to be reduced in size and cost.

For discharging an ink droplet, various methods have been suggested. Among them the most popular method employs a piezoelectric device or a heating device. The former is a method for discharging ink by applying a pressure to the ink by deformation of the piezoelectric device. The latter is a method for discharging ink by pressure of foams generated in the ink heated to boil by the heating device.

Also, there have been suggested various methods for reproducing the aforementioned halftones by using the on-demand type printer which discharges the aforementioned ink droplet. As a first method, the voltage level or pulse width of the voltage pulse to be applied to the piezoelectric device or the heating device is changed so as to control the size of the droplet to be discharged and to change the diameter of a printed dot.

However, this method has a problem that if the voltage level or pulse width to be applied to the piezoelectric device or the heating device is decreased too much, ink discharging is disabled. Consequently, the minimum droplet diameter has a limitation, decreasing the number of gradation steps which can be expressed and disabling expression of a low concentration. That is, this method is insufficient for printing out a natural image.

A second method does not change a dot diameter but employs a pixel composed of a matrix of, for example, 4×4 dots. Gradation expression is realized on this matrix base by using a so-called dither method. In this case, it is possible to express 17 gradation steps.

However, this method also has a problem. For example, if a printing is carried out with the same dot density as in the first method, the resolution is decreased to ¼ of the first method, and only a rough image can be obtained. That is, this method is also insufficient for printing out a natural image.

In order to eliminate these problems, the inventors of the present invention have suggested a printer in which ink is mixed with diluent when discharged, so as to change the concentration of the discharged ink droplet, enabling to control the concentration of a printed dot. That is, the printer is able to print out a natural image without deterioration of the resolution.

Such a printer comprises a printing head having a first nozzle into which a discharge medium is introduced and a second nozzle which is provided adjacent to the first nozzle and into which a quantitative medium is introduced so that a predetermined quantity of the quantitative medium seeps out from the second nozzle toward the first nozzle so as to be mixed with the discharge medium in the vicinity of an opening of the first nozzle; the discharge medium is pushed out from the first nozzle together with the discharge medium which has been mixed with the quantitative medium; and the quantitative medium and the discharge medium are discharged in a direction contained in a plane determined by the first nozzle and the second nozzle. In such a printer, by changing the quantity of the quantitative medium which is either ink or diluent, it is possible to change a mixing ratio of the ink and the diluent so as to change a dot concentration, enabling to print out a natural image. It should be noted that the quantitative medium may be either ink or diluent and the discharge medium may be the remaining one.

As has been described, in the printer which mixes ink with diluent to be discharged, it is necessary to accurately control the mixing ratio of the ink and the diluent so as to accurately express a gradation step in accordance with an image data. In order to achieve this, it is necessary that the ink be sure to be separated from the diluent during a wait state, i.e., when no mixing of the ink with the diluent is carried out. If the ink is in contact with the diluent during the wait state, the ink flows into the nozzle into which the diluent is introduced and the diluent flows into the nozzle into which the ink is introduced. This adversely affects the mixing ratio of ink and the diluent in a following dot, disabling to express an accurate gradation step and accordingly, to obtain a recorded image of a high resolution.

Consequently, in such a printer in which ink is mixed with diluent to be discharged, it is desirable that at least a region sandwiched by the opening of a quantitative nozzle and the opening of a discharge nozzle have a property of liquid repellence.

Also, in the aforementioned printer which discharges ink alone, if the ink is attached around the opening of a discharge nozzle, the discharge direction becomes unstable and it becomes difficult to form a recorded image of a high resolution. Consequently, it is preferable that a region around the nozzle opening have a property of liquid repellence. The same applies to the aforementioned printer which mixes ink with diluent to be discharged.

As a material having such liquid repellence, there can be exemplified polytetrafluoroethylene or the like, and such a material is used for the region around a nozzle opening in the printer as has been described.

On the other hand, when manufacturing such a printer, nozzle formation is usually carried out by means of ablation processing using eximer laser.

However, the aforementioned polytetrafluoroethylene cannot be subjected to ablation processing by eximer laser. To cope with this, as disclosed in Japanese Patent Laid-Open Hei 6-328698, a material which absorbs light having a wave length of eximer laser is dispersed in the polytetrafluoroethylene, thus enabling to apply ablation processing by eximer laser so as to form a nozzle. However, if the method disclosed in the aforementioned Japanese Patent Laid-Open Hei 6-328698 is employed, there arises a problem that either the property of liquid repellence or the property of processability with eximer laser should be sacrificed to a certain degree, i.e., it is difficult to obtain both of the properties simultaneously to a full extent.

It is therefore an object of the present invention to provide a printer which enables to assure the liquid repellence around a nozzle opening so as to form a recorded image of a high resolution and which enables to form a nozzle by means of ablation processing using eximer laser, thus bringing about a preferable productivity.

SUMMARY OF THE INVENTION

In order to achieve the aforementioned objet, the inventors of the present invention conducted various experiments on materials to be used for a printing head of a printer and found that by using polyimide polymer, it is possible to assure both of the property of liquid repellence and the property enabling ablation processing.

That is, a printer according to the present invention includes a printing head having a pressure chamber into which a discharge medium is introduced and a nozzle communicating with the pressure chamber, wherein at least a region around a nozzle opening on a nozzle opening plane is made from polyimide polymer.

Moreover, according another aspect of the invention, the printer includes a printing head having: a first pressure chamber into which a discharge medium is introduced; a second pressure chamber into which a quantitative medium is introduced; a first nozzle which communicates with the first pressure chamber; and a second nozzle which communicates with the second pressure chamber and has an opening adjacent to an opening of the first nozzle, wherein at least a region around the nozzle openings on the nozzle opening plane are made from polyimide polymer.

As the polyimide polymer, total aromatic polyimide is especially preferable among various possible polyimide polymers. More particularly, the polyimide polymer having a structure as shown in the following chemical formula is preferable.

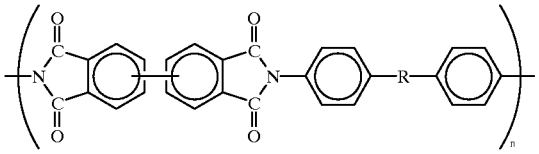

(wherein n is an integer.)

Furthermore, the polyimide polymer having a structure as shown in the following chemical formula is preferable.

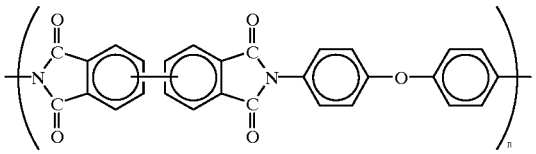

wherein n is an integer.)

Note that the polyimide polymer has preferably a coefficient of water absorption of 0.4 (%) or below when dipped in 23 (°C.) water for 24 hours.

Moreover, the polyimide polymer is preferably one which has been polymerized by heat of 180 (°C.) or below.

Furthermore, the polyimide polymer is preferably polyimide siloxane.

As such a polyimide siloxane, there can be exemplified one having a chemical formula as follows.

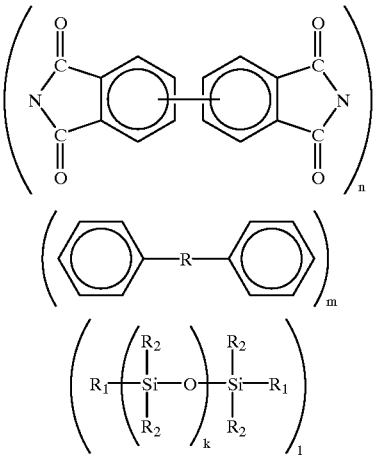

(wherein k, l, m and n are integers.)

As such a polyimide siloxane, there can also be exemplified one having a chemical formula as shown below.

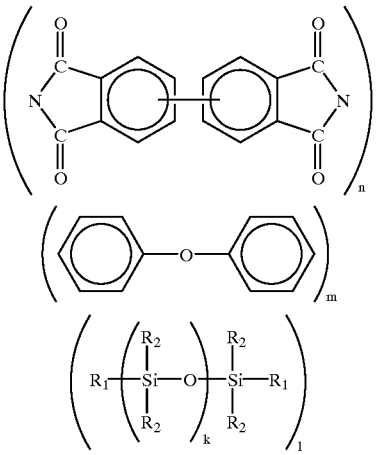

(wherein k, l, m and n are integers.)

It should be noted that in these examples of polyimide siloxane, a part of aromatic hydrocarbon which is bound to nitrogen of the imide binding is replaced by siloxane. The content of Si with respect to polyimide is preferably 3 (% by weight) to 25 (% by weight).

As the polyimide polymers satisfying these conditions, there can be exemplified Yupicoat FS-100L (trade name), Yupifine FP-100 (trade name), UPA-X1Y5, UPA-N221, UPA-N111 which are produced by Ube Kosan Co., Ltd.

In the printer according to the present invention, it is preferable to use polysulfone for the rest of the portion of the printing head, i.e., the portion excluding the nozzle forming portion made from polyimide polymer.

Moreover, in the printer according to the present invention, it is also possible to use polyethersulfone instead of the aforementioned polysulfone, and to use polyimide polymer having a coefficient of water absorption of 1.0 (%) or above when dipped in 23 (°C.) water for 24 hours.

Furthermore, in the printer according to the present invention, it is preferable that the nozzle be formed by ablation processing using eximer laser.

In the printer according to the present invention, polyimide polymer is used as least for a region around the nozzle opening on the nozzle opening plane, which assures the liquid repellence around the nozzle opening. Moreover, because the polyimide polymer is a material appropriate for ablation processing using eximer laser, in the printer according to the present invention, it is possible to employ ablation processing using eximer laser for nozzle formation.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Description will now be directed to embodiments of the present invention with reference to the attached drawings.

Firstly, description will be directed to a printer which discharges only ink as a discharge medium according to a first embodiment of the present invention.

Figure 1:
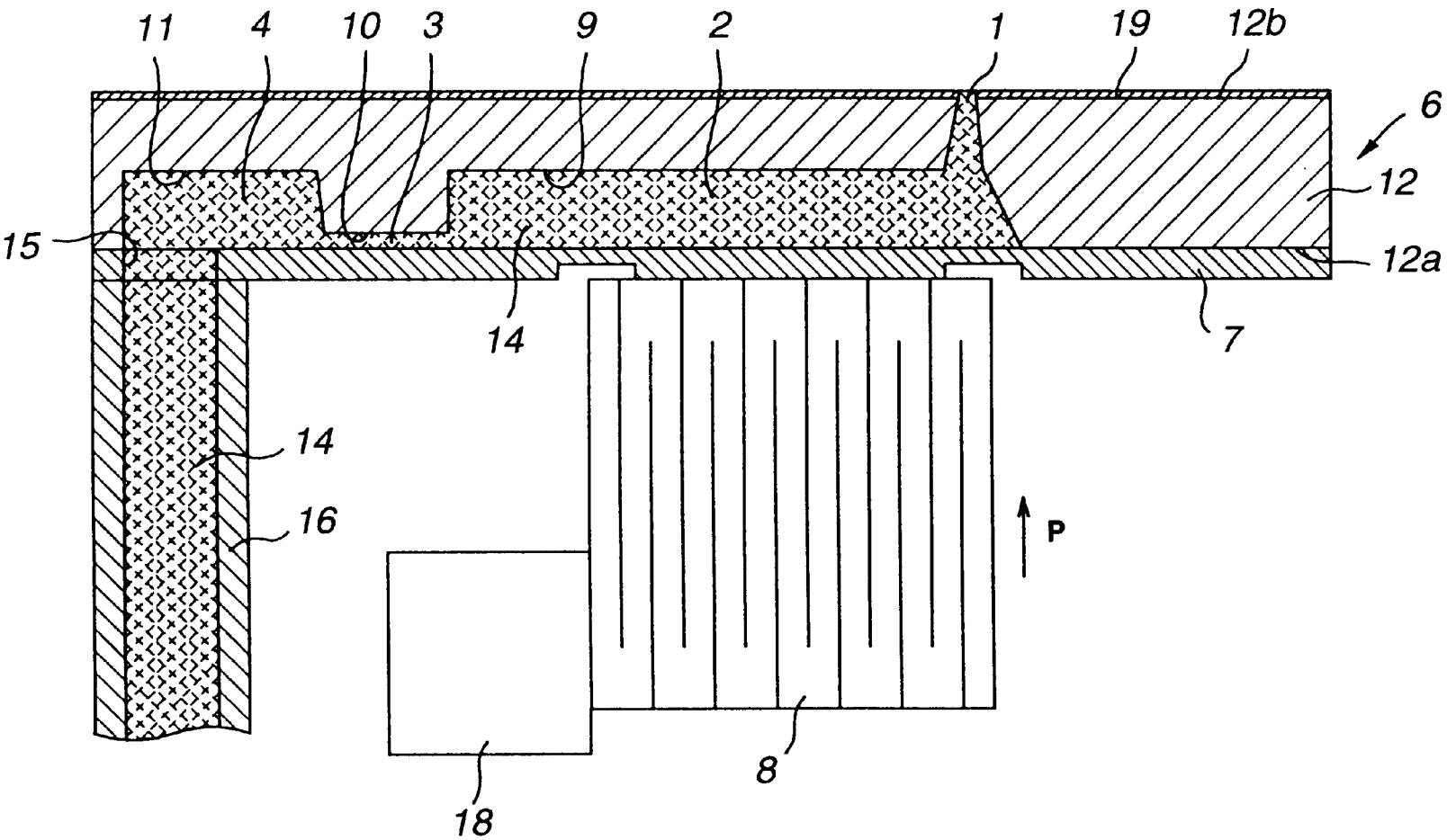
FIG. 1 is a schematic cross sectional view showing an essential portion of a printer according to an embodiment of the present invention.

As shown in FIG. 1, the printer according to the first embodiment has a printing head mainly consisting of an orifice plate member 6 on which a nozzle 1, a ink pressure chamber 2, an ink supply passage 3, and an ink supply port are formed, and a pressure device 8 which is located at a position corresponding at least to the ink pressure chamber 2. Besides, the printer has a drive unit, a control unit, and other components.

The orifice plate member 6 consists of a substrate 12 and a diaphragm 7. The substrate 12 has a first recess 9 forming the ink pressure chamber 2, a second recess 10 which is shallower than the first recess 9 and forms the ink supply passage 3, and a third recess 11 which is deeper than the second recess 10 and forms the ink supply port 4. These recesses are all formed continuously on a main surface 12*a* of the substrate 12. The nozzle 1 is formed as a through hole which extends from the bottom of the first recess 9 through a rear surface 12*b* of the substrate 12. All of the recesses are covered with the diaphragm 7.

Each of the recesses may have a U-shaped cross section. The nozzle 1 may have a circular, elliptic, or rectangular cross section reducing its cross-sectional area toward the rear surface 12*b*.

That is, a space between the third recess 11 and the diaphragm 7 serves as the ink supply port 4; a space between the second recess 10 and the diaphragm 7 serves as the ink supply passage 3; and a space between the first recess 9 and the diaphragm 7 serves as the ink pressure chamber 2. These are formed as a continuous space, and the nozzle 1 is also continuous to this space. Note that an opening 15 is formed at a part of the diaphragm 7 corresponding to the third recess 11.

The opening 15 of the ink supply port 4 is connected to an ink supply tube 16 for supplying ink from an external ink reservoir (not depicted).

Thus, ink 14 is supplied from the external ink reservoir through the ink supply tube 16 into the ink supply port 4, from which the ink 14 is further supplied through the ink supply passage 3 and the ink pressure chamber 2 to the nozzle 1.

Moreover, the diaphragm 7 is formed as a member having partial cuts so that the portion corresponding to the ink pressure chamber 2 is easily displaced.

Furthermore, the pressure device 8 in this embodiment is a layered piezoelectric device. The pressure device 8 is arranged on a portion of the diaphragm 7 corresponding to the ink pressure chamber 2 so that the longitudinal direction of the pressure device 8 orthogonally intersects the diaphragm 7 while the pressure device 8 is fixed by a support block 18 at the opposite side.

The layered piezoelectric device which composes the pressure device 8 expands and shrinks in the longitudinal direction in accordance with a voltage level applied. Because one side of the pressure device 8 is fixed by the support block 18, when the pressure device 8 expands, the diaphragm 7 is pressed in the direction of the arrow P in the drawing and accordingly, a pressure is applied to the ink 14 contained in the ink pressure chamber 2 so that the ink 14 is discharged from the nozzle 1. Note that the ink supply passage 3 is narrower than the ink pressure chamber 2 and there will not be a case when a large amount of ink 14 flows back into the ink supply port 4.

When carrying out a printing by using the printer according to the present embodiment, the pressure device 8 applies a pressure to the ink 14 in the ink pressure chamber 2 so that the ink 14 is discharged from the nozzle 1 toward a recording material (not depicted). The gradation can be expressed by adjusting the dot size or using a matrix.

Figure 2:
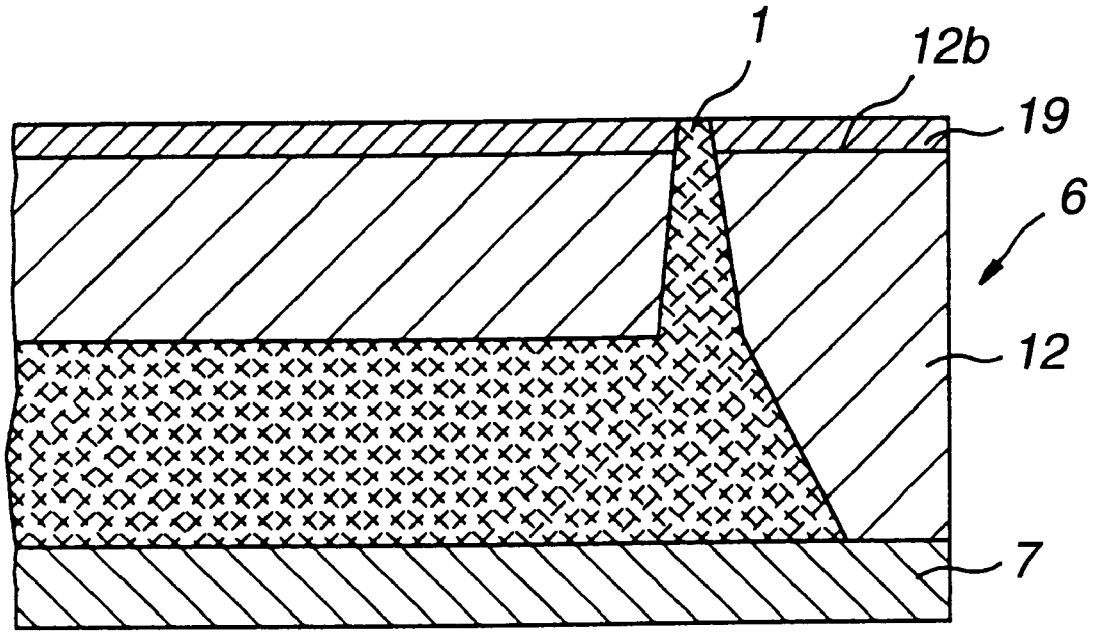
FIG. 2 is an enlarged cross sectional view showing the essential portion of the printer according to the embodiment of the present invention.

Moreover, in the printing head of the printer according to the present embodiment, as shown enlarged in FIG. 2, the orifice plate member 6 uses a polyimide polymer film 19 on the opening plane of the nozzle at least around the opening of the nozzle 1 on the rear surface 12*b* of the substrate 12. Note that in the printer of the present embodiment, as shown in FIG. 1, the polyimide polymer film 19 covers the entire area of the rear surface 12*b*.

As the polyimide polymer to form the polyimide polymer film 19, there can be exemplified various materials. Among them, total aromatic polyimide is preferable. It is more preferable to use the one having a structure as shown in the following chemical formula.

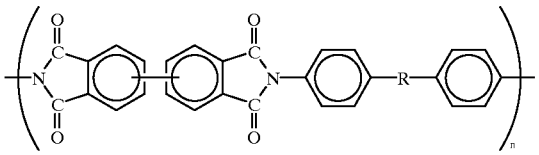

(wherein n is an integer.)

Furthermore, it is preferable to have a structure as shown in the following chemical formula.

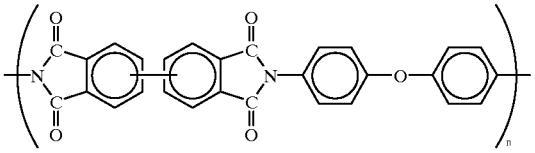

(wherein n is an integer.)

Note that the aforementioned polyimide polymer preferably has a coefficient of water absorption 0.4 (%) or below when dipped in 23 (°C.) water for 24 hours.

Moreover, the aforementioned polyimide polymer is preferably the one which has been polymerized by heat of 180 (°C.) or below.

Furthermore, the aforementioned polyimide polymer is preferably polyimide siloxane.

Such a polyimide siloxane, for example, has a chemical formula as shown below.

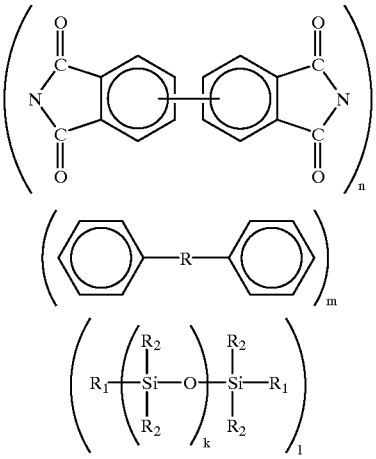

(wherein k, l, m and n are integers.)

There can also be exemplified a polyimide siloxane having a chemical formula as shown below.

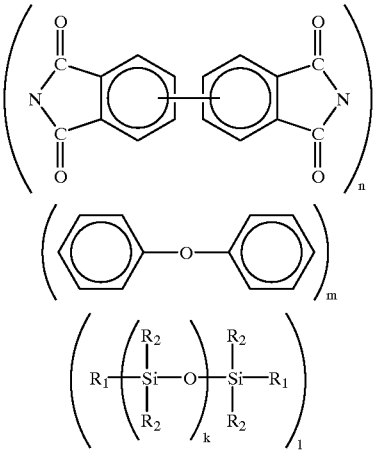

(wherein k, l, m and n are integers.)

It should be noted that in these examples of polyimide siloxane, a part of aromatic hydrocarbon which is bound to nitrogen of the imide binding is replaced by siloxane. The content of Si with respect to polyimide is preferably 3 (% by weight) to 25 (% by weight).

As such polyimide polymers, there can be exemplified Yupicoat FS-100L (trade name), Yupifine FP-100 (trade name), UPA-X1Y5, UPA-N221, and UPA-N111 which are produced by Ube Kosan Co., Ltd.

In the printer according to the present embodiment, the polyimide polymer film 19 having liquid repellence is formed at least around the opening of the nozzle 1 of the printing head. Consequently, liquid repellence is assured around the opening of the nozzle 1, preventing adhesion of unnecessary ink, which enhances discharging stability and enables to form an image of a high resolution.

Figure 3:
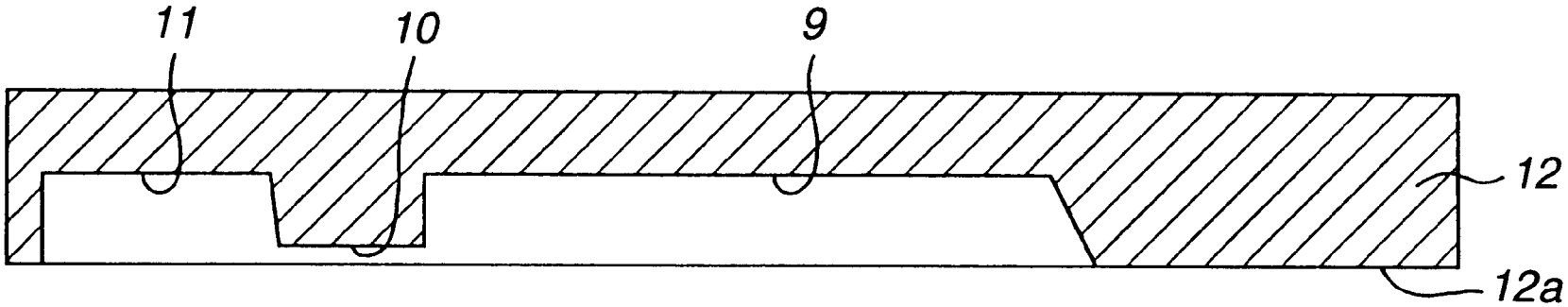
FIG. 3 is a schematic cross sectional view showing a step for forming a substrate in a printing head manufacturing procedure according to the embodiment of the present invention.

Description will now be directed to a manufacturing method of the aforementioned printer. Explanation will be given only on manufacturing of the printing head. Firstly, as shown in FIG. 3, the substrate 12 is prepared with the first recess 9, the second recess 10, and the third recess 11 so that all of the recesses open on the main surface 12*a*. Note that the first recess 9, the second recess 10, and the third recess 11 have the configurations as has been explained above and are formed so as to form a single continuous space as has been explained above. This substrate 12 can be prepared by way of injection molding or compression molding. The material of the substrate 12 may be any of the materials which are usually used for preparing this type of printer. However, it is preferable to use polysulfone or polyethersulfone.

Figure 4:
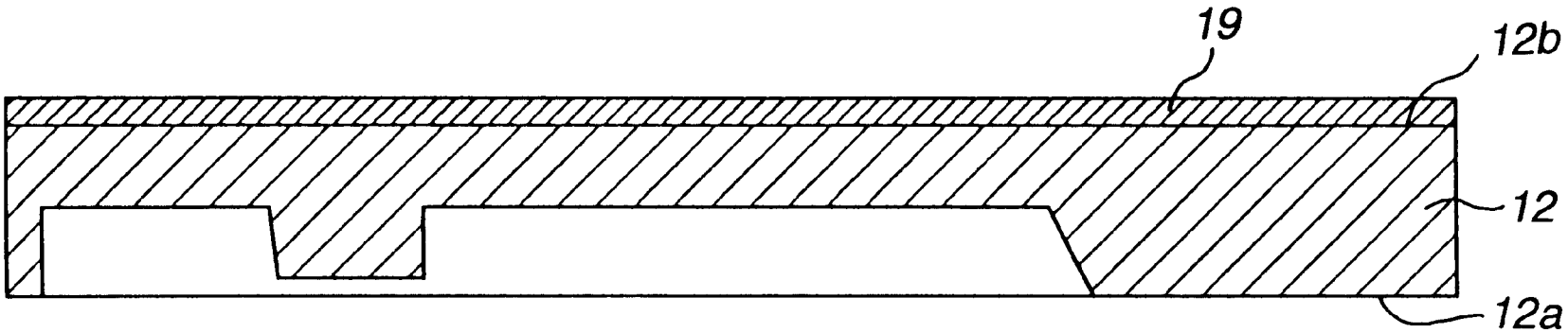
FIG. 4 is a schematic cross sectional view showing a step for forming a polyimide polymer film in the printing head manufacturing procedure according to the embodiment of the present inveniton.

Next, as shown in FIG. 4, the polyimide polymer film 19 is formed on the rear surface 12*b* of the substrate 12, i.e., on the plane opposing the main surface 12*a*. When forming the polyimide polymer film, it is preferable to use polyimide siloxane having a coefficient of water absorption 0.4 (%) or below when dipped in 23 (°C.) water for 24 hours and being polymerized by a heat of 180 (°C.) or below, so as to obtain a film having a thickness ranging from 10 ($\mu$m) to 30 ($\mu$m).

As the polyimide polymer material having a coefficient of water absorption of 0.4 (%) or below, there can be exemplified polyimide overcoat ink, Yupicoat FS-100L (trade name) produced by Ube Kosan Co., Ltd. This polyimide overcoat ink, Yupicoat FS-100L (trade name) produced by Ube Rosan is in an ink state having a viscosity of 220±20 poise when measured at 25 (°C.) by using an E-type viscometer. This ink is applied to the substrate 12 by screen printing and subjected to a heat so as to be polymerized.

As a method to apply to the substrate 12 the overcoat ink Yupicoat FS-100L (trade name) produced by Ube Kosan Co., Ltd., it is also possible to reduce its viscosity by using a diluent solvent (triethylene glycol dimethylether) by means of spin coating before its application.

This polyimide overcoat ink Yupicoat FS-100L (trade name) produced by Ube Kosan Co., Ltd. can be polymerized at a temperature of about 160 (°C.), i.e., lower than the maximum heat-resistant temperature of the polysulfone and polyethersulphone which compose the substrate 12.

Figure 5:
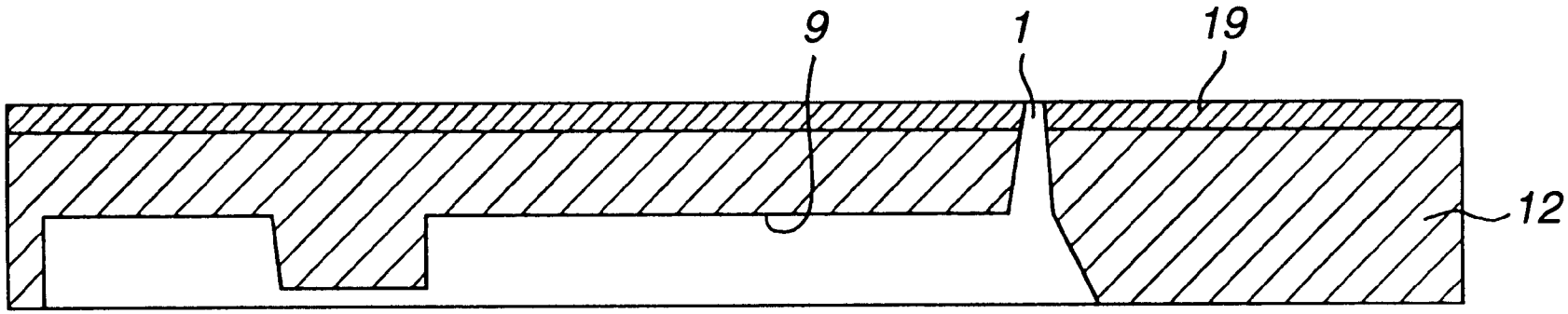
FIG. 5 is a schematic cross sectional view showing a step for forming a nozzle in the printing head manufacturing procedure according to the embodiment of the present invention.

Subsequently, as shown in FIG. 5, an eximer laser processing apparatus is used to form the nozzle 1 as a through hole extending from the bottom of the first recess 9 of the substrate 12 through the substrate 12 and the polyimide polymer film 19. In the printer according to the present embodiment, the substrate 12 is formed from polysulfone or polyethersulfone, and the polyimide polymer film 19 is formed from polyimide polymer. These are the materials which can be subjected to ablation processing using eximer laser. That is, the nozzle 1 can be formed by ablation processing using eximer laser. This significantly simplifies the nozzle forming step, enabling preferable productivity.

Because polysulfone, polyethersulfone, and polyimide polymer have excellent ablation-processability using eximer laser, the nozzle 1 can be formed without any burrs or peeling-off causing defective products. This significantly enhances the production yield. This is also the reason to enable preferable productivity of the printer according to the present embodiment.

Figure 6:
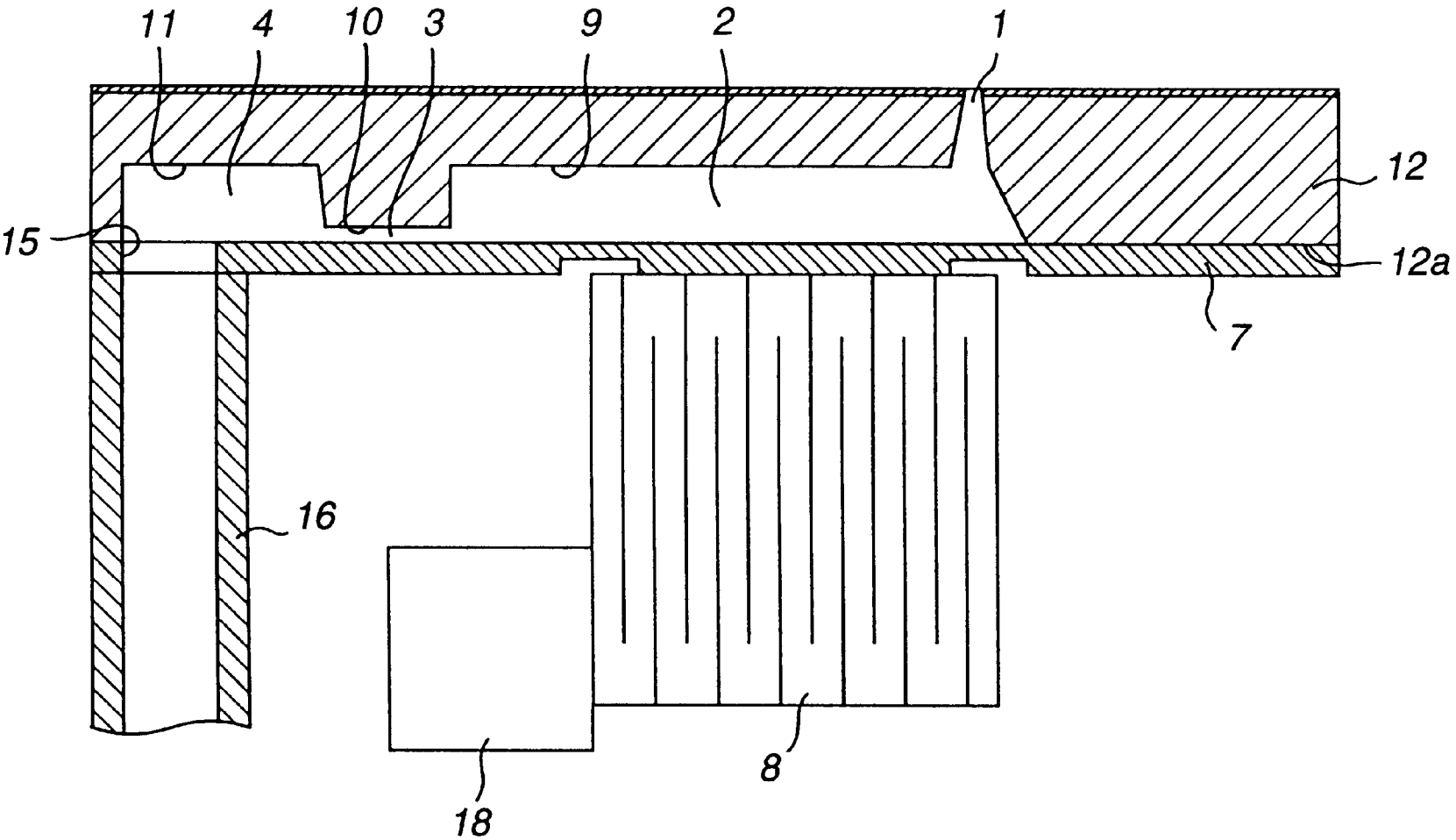
FIG. 6 is a schematic cross sectional view showing a step for arranging a diaphragm in the printing head manufacturing procedure according to the embodiment of the present invention.

As shown in FIG. 6, next step is to arrange the diaphragm 7 serving as a cover on the main surface 12*a* where the recesses of the substrate 12 open. The space defined by the third recess 11 and the diaphragm serves as the ink supply port 4; the space defined by the second recess 10 and the diaphragm 7 serves as the ink supply passage 3; and the space defined by the first recess 9 and the diaphragm 7 serves as the ink pressure chamber 2. These spaces are formed as a single continuous space, and the space is also continuous to the nozzle 1. Note that the diaphragm 7 has the opening 15 at a position facing to the third recess 11 so that the ink supply port 4 is partially opened.

Moreover, the diaphragm 7 has partial cuts so that a part of the diaphragm corresponding to the ink pressure chamber 2 can easily be displaced.

Furthermore, the pressure device 8 which is a layered piezoelectric device is arranged on a portion of the diaphragm 7 corresponding to the ink pressure chamber 2. The pressure device 8 is supported by the support block 8 at the other side.

Moreover, the ink supply tube 16 is connected to the opening 15, thus completing the printing head.

Figure 7:
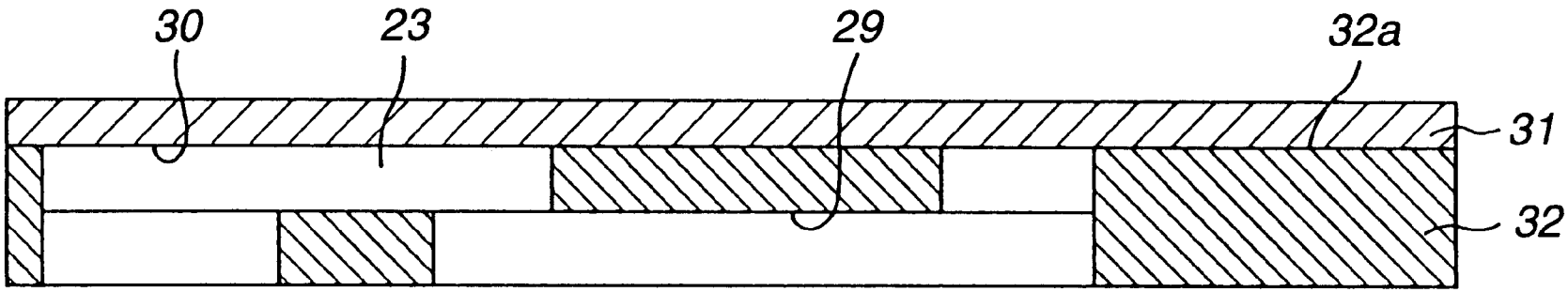
FIG. 7 is a schematic cross sectional view showing a step for preparing a metal plate on which a polymer film is pasted in a printing head manufacturing procedure according to a modified embodiment.

In the aforementioned example, the substrate 12 having predetermined recesses was prepared by injection molding or the like. Instead of such a substrate 12, it is also possible to use a metal plate laminated by a polymer film such as polyimide. That is, as shown in FIG. 7, a metal plate 37 has its main surface 32*a* laminated by a polymer film 31, so as to form a first recess 29 serving as the ink pressure chamber, a third recess 30 serving as the ink supply port, and an ink supply passage 23 connecting the first recess 29 to the third recess 30.

For example, the metal plate 32 may be made from stainless steel, and the polymer film 31 may be a polyimide film or the like. Note that the polyimide film preferably has a certain wettability because a nozzle is formed through this polyimide film. That is, it is preferable that the polyimide film have a coefficient of water absorption of 1. 0 (%) or above when dipped in 23 (°C.) water for 24 hours. As such a polyimide film, there can be exemplified Capton Film (trade name) produced by Toray-Du Pont Co., Ltd. These two materials, i.e., the metal plate and the film are preferably pasted to each other by using a polyimide material having a low glass-transition temperature.

It should be noted that a substrate thus prepared from the metal plate 32 and the polymer film 31 does not fall behind the aforementioned unitary molded substrate in chemical resistance and exhibits a superior heat resistance.

Figure 8:
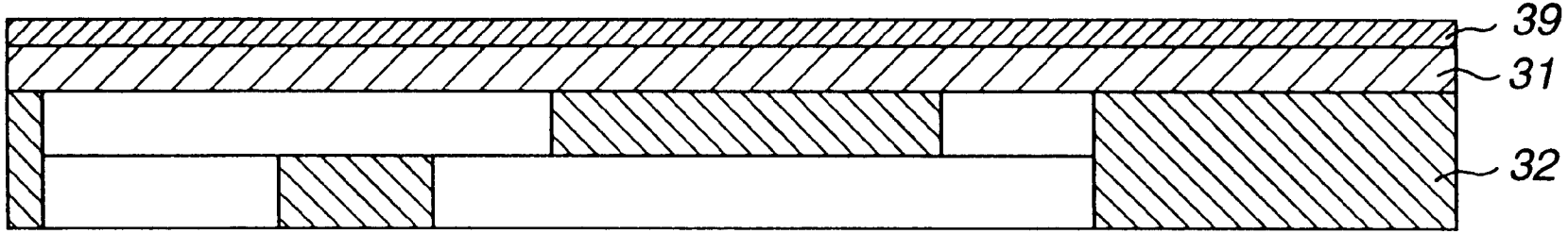
FIG. 8 is a schematic cross sectional view showing a step for forming a polyimide polymer film in the printing head manufacturing procedure according to the modified embodiment.

FIG. 8 shows a following step when a polyimide polymer film 39 is formed on the polymer film 31. The polyimide polymer film 39, like the polyimide polymer film 19, preferably have a coefficient of water absorption of 0.4 (%) or below when dipped in 23 (°C.) water for 24 hours and is made from polyimide siloxane formed into a film having a thickness of 10 ($\mu$m) to 30 ($\mu$m).

As such a polyimide polymer material, there can be exemplified a polyimide overcoat ink Yupicoat FS-100L (trade name) produced by Ube Kosan Co., Ltd. Since the substrate used here has an excellent heat resistance, it is possible to use the polyimide coating material Yupifine FP FP-100 (trade name) produced by Ube Kosan Co., Ltd.

Note that the Yupifine FP-100 (trade name) produced by Ube Kosan Co., Ltd. has a viscosity of 60 poise under the condition of 30 (°C.), which can be painted on the polymer film 31 by way of potting and heated by a heat of about 180 (°C.) so as to be polymerized.

Figure 9:
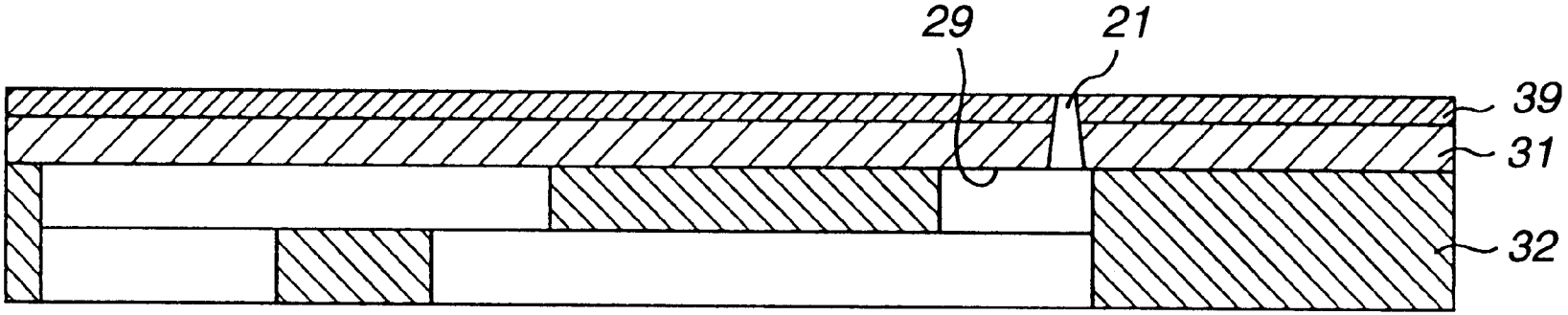
FIG. 9 is a schematic cross sectional view showing a step for forming a nozzle in the printing head manufacturing procedure according to the modified embodiment.

FIG. 9 shows a following step when the nozzle 21 is formed by using an eximer laser processing apparatus, so as to extend from the bottom of the recess 29 of the metal plate 32 through the polymer film 31 and the polyimide polymer film 39. In the printer according to the present embodiment, the polymer film 31 is made from polyimide and the polyimide polymer film 39 is from polyimide polymer, both of which can be subjected to ablation processing using eximer laser. Consequently, the nozzle 21 can be formed by ablation processing using eximer laser. Thus, in the printer of the present embodiment, the nozzle forming step is simplified, increasing the productivity.

Moreover, since these polyimide polymers have an excellent processability by ablation using eximer laser, the nozzle 21 can be formed without burrs or peeling-out, which may cause defective products. Thus, the production yield is increased. This also promises a preferable productivity.

Subsequently, as has been described above, a diaphragm, an ink supply tube, and a piezoelectric device are arranged, completing the printing head.

Thus, in the printer according to the present embodiment, a liquid-repellent polyimide polymer is used at least around the nozzle opening on the nozzle opening plane of the printing head. This assures the liquid repellence around the nozzle opening portion, assuring the ink discharge stability and enabling to obtain a recorded image of a high quality. Moreover, because the aforementioned polyimide polymer is an adequate material for ablation processing using eximer laser, in the printer according to the present embodiment, it is possible to use eximer laser for ablation so as to form a nozzle. This simplifies the manufacturing procedure, increasing the productivity.

Furthermore, in the printer according to the present embodiment, except for the portion to form a nozzle of the printing head, i.e., except for the portion made of polyimide polymer for forming the nozzle of the printing head, the material used is polysulfone or polyethersulfone, and the polyimide polymer having the coefficient of water absorption as 1.0 (%) or above when dipped in 23 (°C.) water for 24 hours. These materials can be subjected ablation processing using eximer laser, so as to form a nozzle. This simplifies the production procedure and increases the productivity.

Moreover, since these materials have an excellent property when subjected to ablation processing using eximer laser, the nozzle can be formed without causing burrs or peeling-out. This increases the production yield and accordingly, the printer according to the present invention has a preferable productivity.

Description will now be directed to a printer in which ink is mixed with diluent to be discharged, according to another (second) embodiment of the present invention.

Figure 10:
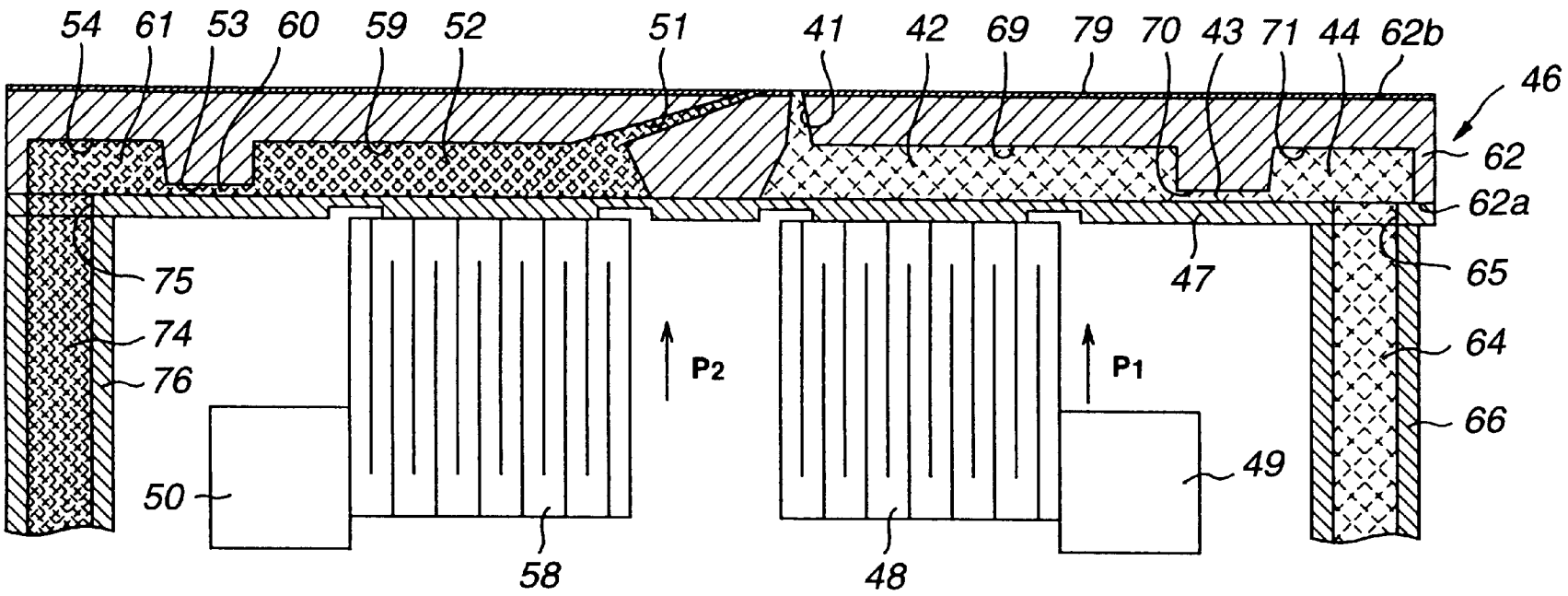
FIG. 10 is a schematic cross sectional view showing an essential portion of a printer according to another (second) embodiment of the present invention.
Figure 11:
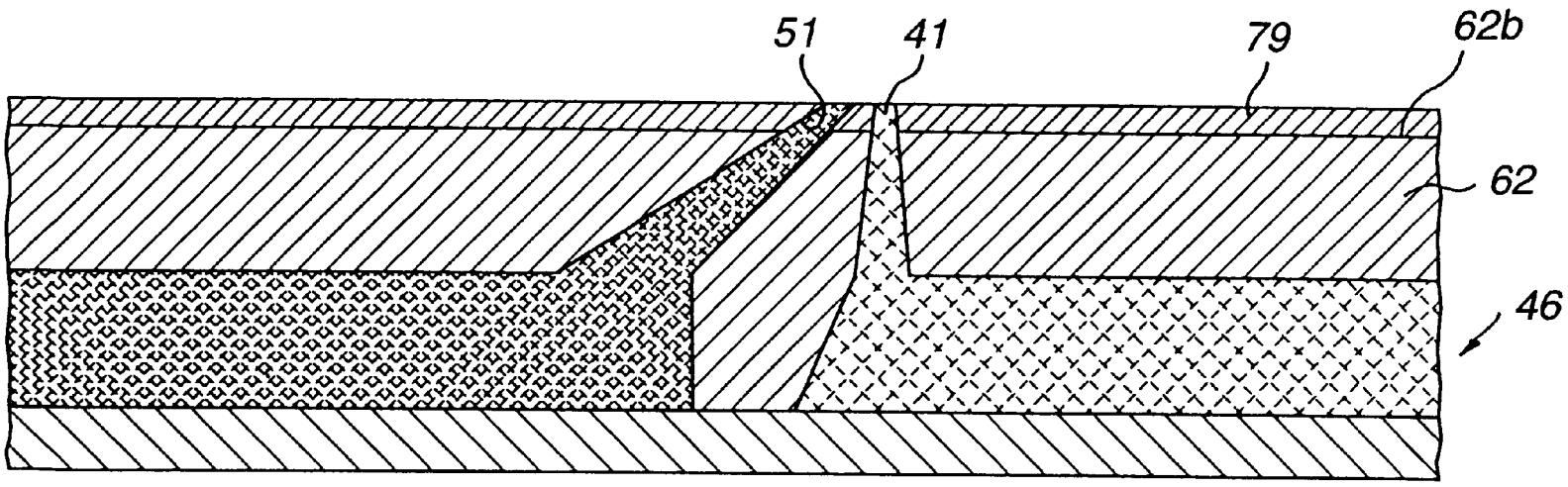
FIG. 11 is an enlarged cross sectional view showing the essential portion of the printer according to the second embodiment of the present invention.

FIG. 10 shows a printing head of he printer according to the second embodiment. The printing head mainly consists of: an orifice plate member 46 having a first nozzle 41, a discharge medium pressure chamber 42, a discharge medium supply passage 43, a discharge medium supply port 44, a second nozzle 51, a quantitative medium pressure chamber 52, a quantitative medium supply passage 53, and a quantitative medium supply port 54; a first pressure device 48 arranged at a position corresponding to the discharge pressure chamber 42; and a second pressure device 58 arranged at a position corresponding to the quantitative medium pressure chamber 52 in addition to a drive unit and a control unit. In FIG. 11, the quantitative medium is shown at 52*a* and the discharge medium is shown at 42*a*.

The orifice plate member 46 is composed by a substrate 62 having recesses serving as the pressure chambers, nozzles and others, and a diaphragm 47 which also serves as a cover member for covering the aforementioned recesses.

The substrate 62 has a first recess 69 formed to serve as the discharge medium pressure chamber 42, a second recess 70 formed shallower than the first recess 69 so as to serve as the discharge medium supply passage 43, and a third recess 71 formed deeper than the second recess 70 so as to serve as the discharge medium supply port 44, all recesses being continuous to each other to open on a main surface 62*a* of the substrate 62*a*. Moreover, the nozzle 41 is formed as a through hole extending from the bottom of the first recess 69 through a rear surface 62*b* of the substrate 62.

Furthermore, the substrate 62 has a fourth recess 59 formed to serve as the quantitative medium pressure chamber 52, a fifth recess formed shallower than the fourth recess 59 so as to serve as the quantitative medium supply passage 53, and a sixth recess 61 formed deeper than fifth recess so as to serve as the quantitative medium supply port 54, the recesses being formed continuously to each other to open on the main surface 62*a*. Moreover, the second nozzle 51 is formed as a through hole extending from the bottom of the fourth recess 9 through the rear surface 62*b* of the substrate 62.

The first nozzle 41 and the second nozzle 51 are formed adjacent to each other and these first and second nozzles 41 and 51 are sandwiched between the discharge pressure chamber 42 and the quantitative medium pressure chamber 52, which are sandwiched between the discharge medium supply passage 43 and the quantitative medium supply passage 53, which are further sandwiched between the discharge medium supply port 44 and the quantitative medium supply port 54.

Each of the recesses may be formed as a U-shaped groove portion, whereas each of the first and the second nozzles 41 and 51 may be formed as a through hole having a circular, elliptic, or rectangular cross section, while reducing its area toward the rear surface 62*b*.

That is, the space defined by the third recess 71 and the diaphragm 47 serves as the discharge medium supply port 44; the space defined by the second recess and the diaphragm 47 serves as the discharge medium supply passage 43; and the space defined by the first recess 69 and the diaphragm 47 serves as the discharge medium pressure chamber 42, all of which are formed as a continuous single space, which is also continuous to the first nozzle 41. Note that the diaphragm 47 has an opening 65 at a position facing to the third recess 71.

The opening 65 of the discharge medium supply port 44 is connected to a discharge medium supply tube 66 for supplying a discharge medium 64 from an external discharge medium reservoir (not depicted).

Consequently, the discharge medium 64 is supplied from the external discharge medium reservoir through the discharge medium supply passage 66 into the discharge medium supply port 44, and further supplied from this discharge medium supply port 44 through the discharge medium supply passage 43 into the discharge medium pressure chamber 42 and the first nozzle 41.

On the other hand, the space defined by the sixth recess 61 and the diaphragm 47 serves as the quantitative medium supply port 54; the space defined by the fifth recess 60 and the diaphragm 47 serves as the quantitative medium supply passage 53; and the space defined by the fourth recess 59 and the diaphragm 47 serves as the quantitative medium pressure chamber 52, all of which are formed as a single continuous space, which is further continuous to the second nozzle 51. Note that the diaphragm 47 has an opening 75 at a position facing to the sixth recess 61.

The opening 75 of the quantitative medium supply port 54 is connected to a quantitative medium supply tube 76 for supplying a quantitative medium 74 from an external quantitative medium reservoir (not depicted).

Consequently, the quantitative medium 74 is supplied from the external quantitative medium reservoir through the quantitative medium supply tube 76 into the quantitative medium supply port 54, and further from this quantitative medium supply port 54 through the quantitative medium supply passage 53 into the quantitative medium pressure chamber 52 and the second nozzle 51.

The diaphragm 47 has partial cuts so that the portions corresponding to the discharge medium pressure chamber 42 and the quantitative medium pressure chamber 52 can easily be displaced.

Furthermore, the aforementioned pressure devices 48 and 58 may be layered piezoelectric devices or the like. The present (second) embodiment shows a case using layered piezoelectric devices. The pressure device 48 is arranged so that the longitudinal direction of the pressure device 48 orthogonally intersects the portion of the diaphragm 47 which corresponds to the discharge medium pressure chamber 42 and is fixed by a support block 49 at the opposite side. Similarly, the pressure device 58 is arranged on a portion of the diaphragm 47 corresponding to the quantitative medium pressure chamber 52 and is fixed by a support block 50 at the opposite side.

Each of the layered piezoelectric devices serving as the pressure devices 48 and 58 expands and shrinks in the longitudinal direction in accordance with a voltage level applied. Since one end is fixed by the support block 48, 50, when the pressure devices 48, 58 expand, the diaphragm 47 is pushed in the direction shown by the arrow $P_1$, $P_2$ in the drawing. This applies a pressure to the discharge medium 64 in the discharge medium pressure chamber 42 and to the quantitative medium 74 in the quantitative medium pressure chamber 52 so that the discharge medium 64 is pushed out of the first nozzle 41 and the quantitative medium 74 is pushed out of the second nozzle 51. At this moment, the discharge medium 64 and the quantitative medium 74 will not go back in a large amount into the discharge medium supply port 44 and the quantitative medium supply port 54, respectively, because the discharge medium supply passage 43 and the quantitative medium supply passage 53 are narrower than the discharge medium pressure chamber 42 and the quantitative medium supply passage 52, respectively.

Figure 11A:
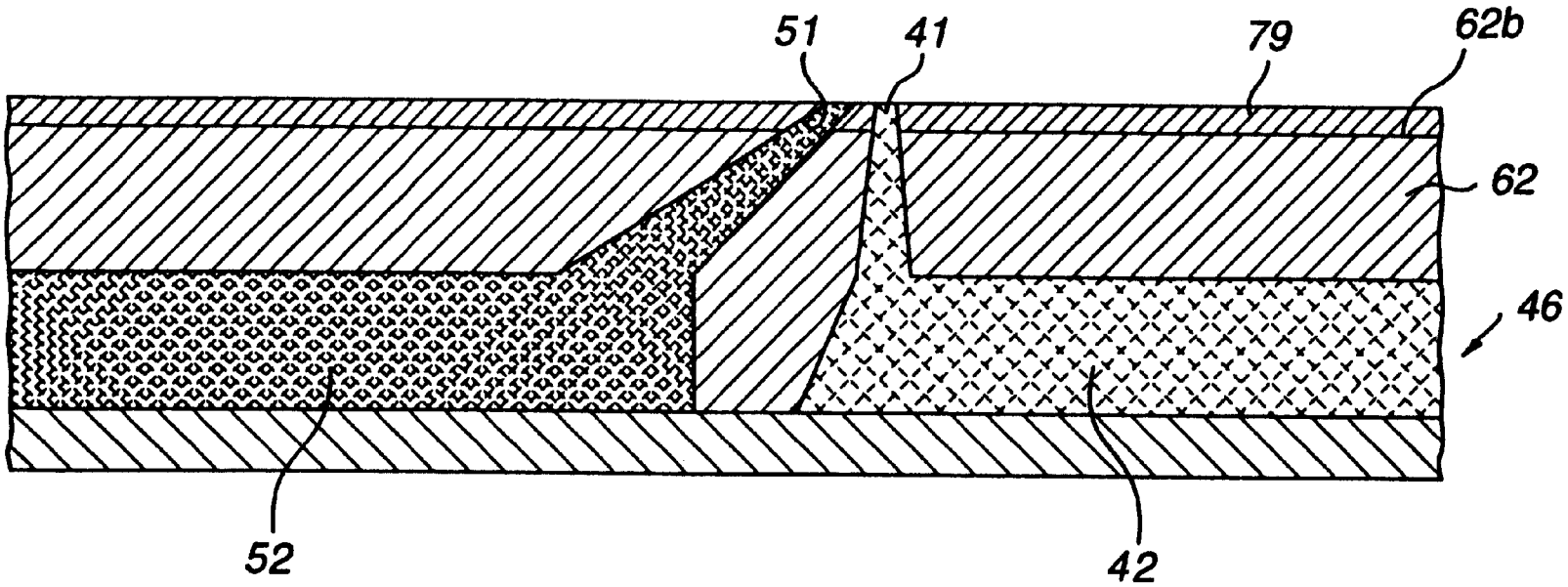
FIG. 11A is an enlarged cross sectional view illustrating the seepage of the quantitative medium towards the discharge medium and the consequential mixture of the quantitative medium and discharge medium according to the present invention.

A printing using the printer according to the second embodiment is carried out as follows. Firstly, the pressure device 58 functions to apply a pressure to the quantitative medium 74 contained in the quantitative medium pressure chamber 52 so that a predetermined quantity of the quantitative medium 74 is pushed toward the first nozzle 41 so as to be supplied to the vicinity of the opening of the first nozzle 41, and then is mixed with the discharge medium 64 in the vicinity of the opening of the first nozzle 41 as shown in FIG. 11A. Note that the quantity of the quantitative medium 74 to be pushed is controlled by the voltage level or pulse width applied to the pressure device 58.

Subsequently, the pressure device 48 functions to apply a pressure to the discharge medium 64 contained in the discharge medium pressure chamber 42 so as to discharge toward a recording medium (not depicted) the discharge medium 64 together with a liquid mixture of the quantitative medium 74 and the discharge medium 64 in the vicinity of the opening of the first nozzle 41. The gradation can be adjusted by changing the quantity of the quantitative medium to be pushed out, so that the dot concentration is changed. Note that the discharge medium is one of ink and diluent, and the quantitative medium is the other.

In the printing head of the printer according to the second embodiment, as shown enlarged in FIG. 11, the polyimide polymer film 79 is arranged on the plane of the orifice plate member 46 through which the nozzle 41 and the nozzle 51 open, i.e., at least around openings of the first nozzle 41 and the second nozzle 51 on the rear surface 62*b* of the substrate 62. Note that, as shown in FIG. 10, in the printer according to the second embodiment, the polyimide polymer film 79 is arranged on the entire area of the rear surface 62*b*.

As the polyimide polymer forming the polyimide polymer film 79. there can be exemplified various materials. However, the total aromatic polyimide is preferable. More particularly, the one having a chemical formula as shown below is preferable.

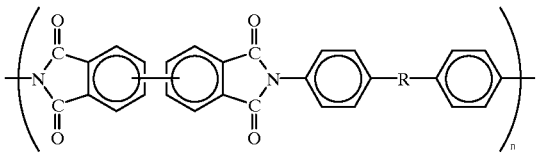

(wherein n is an integer.)

Furthermore, the polyimide polymer having a chemical formula as shown below is preferable.

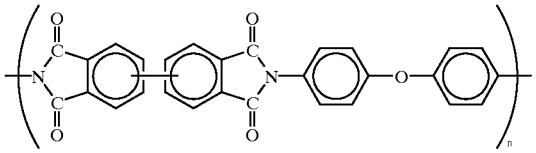

(wherein n is an integer.)

Note that the polyimide polymer has preferably a coefficient of water absorption of 0.4 (%) or below when dipped in 23 (°C.) water for 24 hours.

Moreover, the polyimide polymer is preferably one which has been polymerized by heat of 180 (°C.) or below.

Furthermore, the polyimide polymer is preferably polyimide siloxane.

As such a polyimide siloxane, there can be exemplified one having a chemical formula as follows.

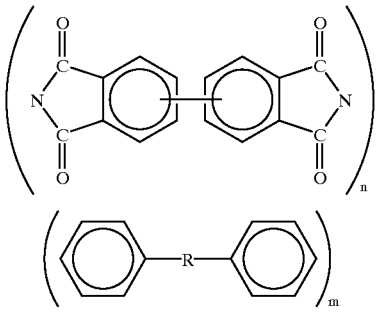

-continued

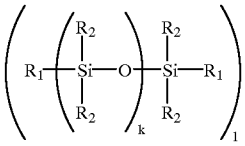

(wherein k, l, m and n are integers.)

As such a polyimide siloxane, there can also be exemplified one having a chemical formula as shown below.

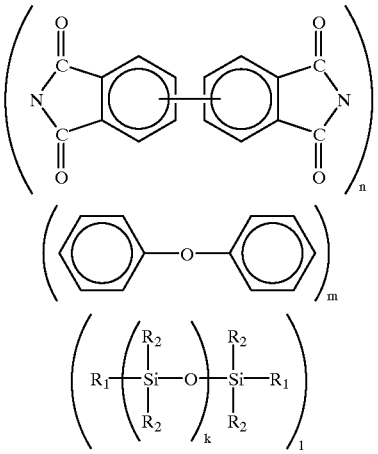

(wherein k, l, m and n are integers.)

It should be noted that in these examples of polyimide siloxane, a part of aromatic hydrocarbon which is bound to nitrogen of the imide binding is replaced by siloxane. The content of Si with respect to polyimide is preferably 3 (% by weight) to 25 (% by weight).

As the polyimide polymers satisfying these conditions, there can be exemplified Yupicoat FS-100L (trade name) and Yupifine FP-100 (trade name) which are produced by Ube Kosan Co., Ltd.

In the printer according to the second embodiment, the polyimide polymer film 79 having a property of liquid repellence is formed at least around the openings of the first nozzle 41 and the second nozzle 51 on the opening plane of the first nozzle 41 and the second nozzle 51 of the printing head, assuring the liquid repellence around the openings of the first nozzle 41 and the second nozzle 51. That is, in a wait state when ink is not mixed with diluent, ink is sure to be separated from the diluent, which enables to accurately control the ink-diluent mixing ratio for each dot. This further enables to accurately express gradation in accordance with an image data, forming a recorded image of a high resolution.

Figure 12:
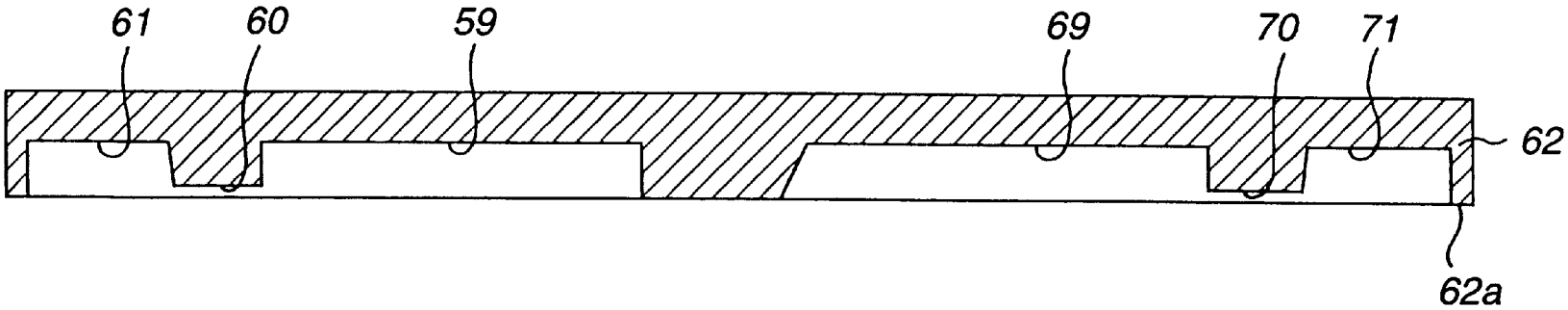
FIG. 12 is a schematic cross sectional view showing a step for forming a substrate in a printing head manufacturing procedure according to the second embodiment of the present invention.

Description will now be directed to a manufacturing method of the above-described printer. Note that manufacturing of only the printing head will be explained here. Firstly, as shown in FIG. 12, the substrate 62 is prepared so as to have the first recess 69, the second recess 70, the third recess 71, the fourth recess 59, the fifth recess 60, and the sixth recess 61, all of which have openings on the main surface 62*a*. Note that the first recess 69, the second recess 70, and the third recess 71 are continuously formed, each having the configuration as described above. Similarly, the fourth recess 59, the fifth recess 60, and the sixth recess 61 are continuously formed, each having the configuration as described above. This substrate 62 can be prepared by means of injection molding or compression molding. The material to form the substrate 62 may be any of the materials which are normally used for preparing this type of printer. However, polysulfone or polyethersulfone is preferable.

Figure 13:
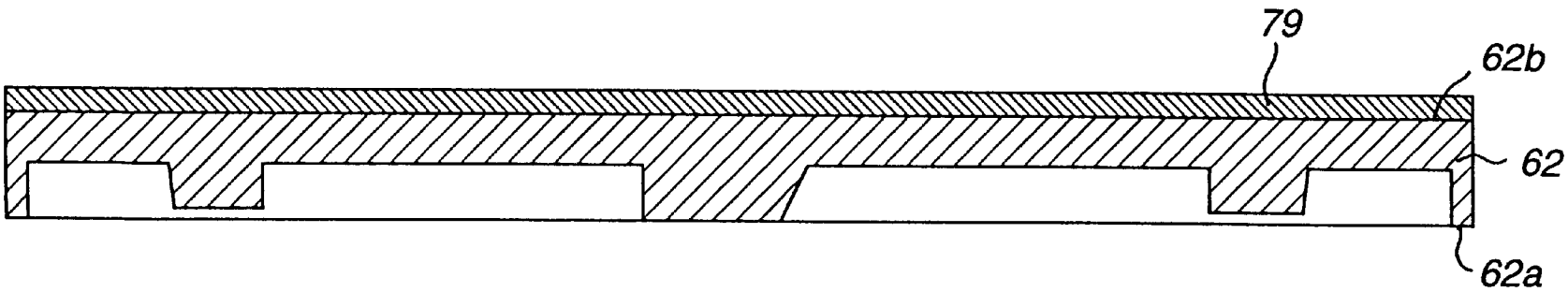
FIG. 13 is a schematic cross sectional view showing a step for forming a polyimide polymer film in the printing head manufacturing procedure according to the second embodiment of the present inveniton.

Next, as shown in FIG. 13, the polyimide polymer film 79 is formed on the rear surface 62*b* of the substrate 62. For forming this polyimide polymer film 79, it is preferable to use polyimide siloxane having a coefficient of water absorption as 0.4 or below when dipped in 23 (°C.) water and is polymerized by a heat of 180 (°C.) or below so as to form a film of 10 (μm) to 30 (μm).

As the polyimide polymer material having a coefficient of water absorption of 0.4 (%) or below, there can be exemplified polyimide overcoat ink, Yupicoat FS-100L (trade name) produced by Ube Kosan Co., Ltd. This polyimide overcoat ink, Yupicoat FS-100L (trade name) produced by Ube Kosan is in an ink state having a viscosity of 220±20 poise when measured at 25 (°C.) by using an E-type viscometer. This ink is applied to the substrate 62 by screen printing and subjected to a heat so as to be polymerized.

As a method to apply to the substrate 62 the overcoat ink Yupicoat FS-100L (trade name) produced by Ube Kosan Co., Ltd., it is also possible to reduce its viscosity by using a diluent solvent (triethylene glycol dimethylether) before applying it by means of spin coating.

This polyimide overcoat ink Yupicoat FS-100L (trade name) produced by Ube Kosan Co., Ltd. can be polymerized at a temperature of about 160 (°C.), i.e., lower than the maximum heat-resistant temperature of the polysulfone and polyethersulphone which compose the substrate 62.

Figure 14:
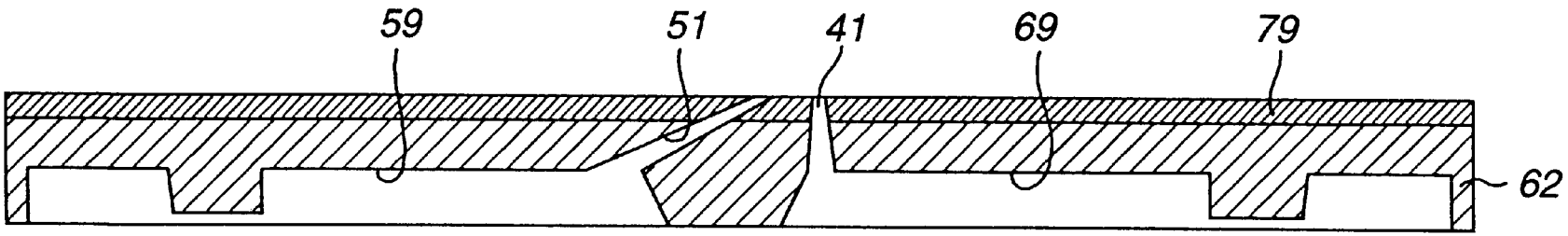
FIG. 14 is a schematic cross sectional view showing a step for forming nozzles in the printing head manufacturing procedure according to the second embodiment of the present invention.

Next, as shown in FIG. 14, the first nozzle 41 is formed by using an eximer laser processing apparatus, so as to extend from the bottom of the first recess 69 of the substrate 62 through this substrate 62 and the polyimide polymer film 79. Moreover, the second nozzle 51 is formed by using the eximer laser processing apparatus, so as to extend from the bottom of the fourth recess 59 of the substrate 62 through this substrate 62 and the polyimide polymer film 79. In the printer according to the second embodiment, both of the substrate 62 made from polysulfone or polyethersulfone and the polyimide polymer film 79 made from polyimide polymer can be subjected to ablation processing using eximer laser. Consequently, the first nozzle 41 and the second nozzle 51 can be prepared by ablation processing using eximer laser. Thus, in the printer according to the present embodiment, the nozzle forming step is simplified, enabling to obtain a preferable productivity.

Because polysulfone, polyethersulfone, and polyimide polymer have excellent ablation-processability using eximer laser, the nozzle 41 and the nozzle 51 can be formed without any burrs or peeling-off causing defective products. This significantly enhances the production yield. This is also the reason to enable preferable productivity of the printer according to the present embodiment.

Figure 15:
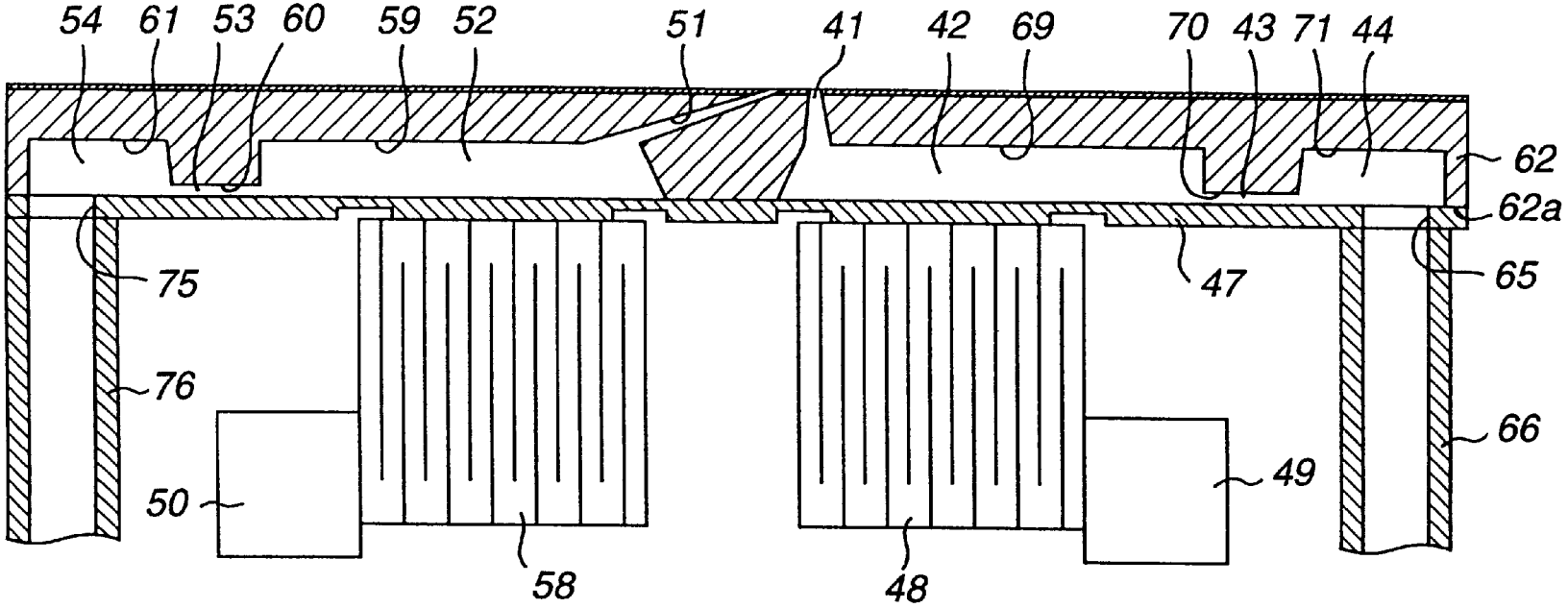
FIG. 15 is a schematic cross sectional view showing a step for arranging a diaphragm in the printing head manufacturing procedure according to the second embodiment of the present invention.

As shown in FIG. 15, the next step is to arrange the diaphragm 47 serving as a cover on the main surface 62*a* where the recesses of the substrate 12 open. The space defined by the third recess 71 and the diaphragm 47 serves as the discharge medium supply port 44; the space defined by the second recess 70 and the diaphragm 47 serves as the discharge medium supply passage 43; and the space defined by the first recess 69 and the diaphragm 47 serves as the discharge medium pressure chamber 42. These spaces are formed as a single continuous space, and the space is also continuous to the first nozzle 41. Note that the diaphragm 47 has the opening 65 at a position facing to the third recess 71 so that the discharge medium supply port 44 is partially opened.

Moreover the diaphragm 47 also defines the following spaces: the space defined by the sixth recess 61 and the diaphragm 47 serves as the quantitative medium supply port 53; the space defined by the fifth recess 60 and the diaphragm 47 serves as the quantitative medium supply passage 53; and the space defined by the fourth recess 59 and the diaphragm 47 serves as the quantitative medium pressure chamber 42. These spaces are formed as a single continuous space, and the space is also continuous to the second nozzle 51. Note that the diaphragm 47 has the opening 75 at a position facing to the sixth recess 61 so that the quantitative medium supply port 54 is partially opened.

Moreover, the diaphragm 47 has partial cuts so that those portions of the diaphragm that correspond to the discharge medium pressure chamber 42 and the quantitative medium pressure chamber 52 can easily be displaced.

Furthermore, the pressure device 48 which is a layered piezoelectric device is arranged on a portion of the diaphragm 47 corresponding to the discharge medium pressure chamber 42. The pressure device 58 which is a layered piezoelectric device is also arranged on a portion of the diaphragm 47 corresponding to the quantitative medium pressure chamber 52. The pressure devices 48 and 58 are supported by the support blocks 49 and 59, respectively, each located at the opposite side.

Moreover, the discharge medium supply tube 66 is arranged so as to be connected to the opening 65, and the quantitative medium supply tube 76 is arranged so as to be connected to the opening 75, thus completing the printing head.

Figure 16:
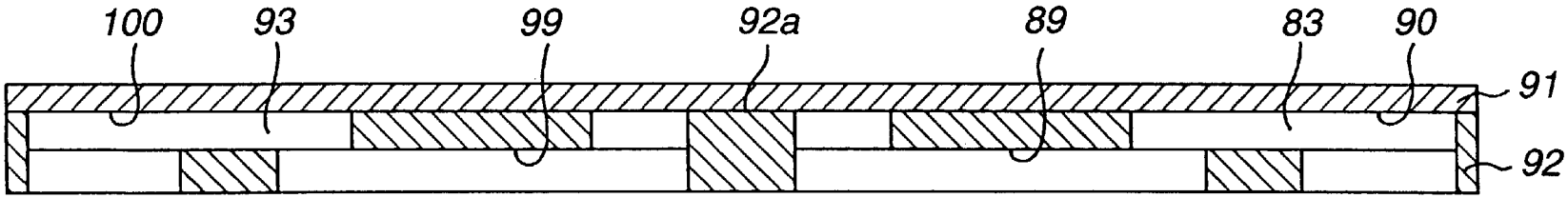
FIG. 16 is a schematic cross sectional view showing a step for preparing a metal plate on which a polymer film is pasted in a printing head manufacturing procedure according to a modification of the second embodiment.

In the aforementioned example, the substrate 62 having predetermined recesses was prepared by injection molding or the like. Instead of such a substrate 62, it is also possible to use a metal plate laminated by a polymer film made from polyimide or the like. That is, as shown in FIG. 16, a metal plate 92 has its main surface 92*a* laminated by a polymer film 91, so as to form a first recess 89 serving as the discharge medium pressure chamber, a third recess 90 serving as the discharge medium supply port, and a discharge medium supply passage 83 connecting the first recess 89 to the third recess 90, as well as a fourth recess 99 serving as the quantitative medium pressure chamber, a sixth recess 100 serving as the quantitative medium supply port, and a quantitative medium supply passage 93 connecting the fourth recess 99 to the sixth recess 100.

The metal plate 92, for example, may be made from stainless steel, and the polymer film 91 may be a polyimide film or the like. Note that the polyimide film preferably has a certain wettability because nozzles are to be formed through this polyimide film. That is, it is preferable that the polyimide film have a coefficient of water absorption of 1. 0 (%) or above when dipped in 23 (°C.) water for 24 hours. As such a polyimide film, there can be exemplified Capton Film (trade name) produced by Toray-Du Pont Co., Ltd. These two materials, i.e., the metal plate and the film are preferably pasted to each other by using a polyimide material having a low glass-transition temperature.

It should be noted that a substrate thus prepared from the metal plate 92 and the polymer film 91 does not fall behind the aforementioned unitary molded substrate in chemical resistance and exhibits a superior heat resistance.

Figure 17:
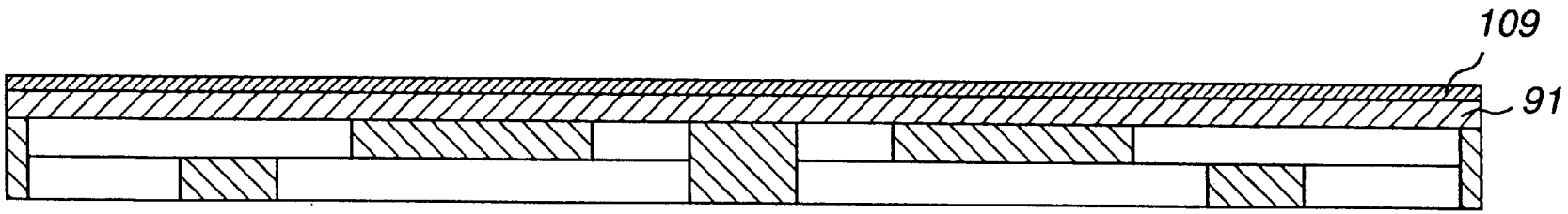
FIG. 17 is a schematic cross sectional view showing a step for forming a polyimide polymer film in the printing head manufacturing procedure according to the modified second embodiment.

FIG. 17 shows a following step when a polyimide polymer film 109 is formed on the polymer film 91. The polyimide polymer film 109, like the polyimide polymer film 79, preferably have a coefficient of water absorption of 0.4 (%) or below when dipped in 23 (°C.) water for 24 hours and is made from polyimide siloxane formed into a film having a thickness of 10 ($\mu$m) to 30 ($\mu$m).

As such a polyimide polymer material, there can be exemplified a polyimide overcoat ink Yupicoat FS-100L (trade name) produced by Ube Kosan Co., Ltd. Since the substrate used here has an excellent heat resistance, it is possible to use the polyimide coating material Yupifine FP-100 (trade name) produced by Ube Kosan Co., Ltd.

Note that the Yupifine FP-100 (trade name) produced by Ube Kosan Co., Ltd. has a viscosity of 60 poise under the condition of 30 (°C.), which can be painted on the polymer film 91 by way of potting and heated by a heat of about 180 (°C.) so as to be polymerized.

Figure 18:
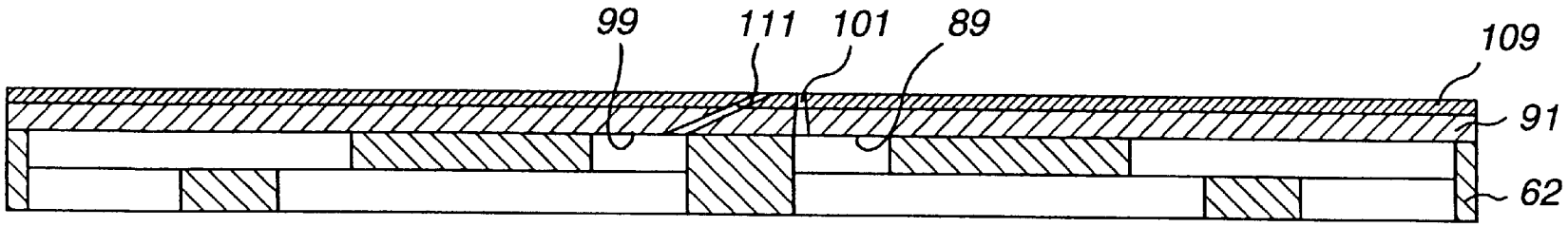
FIG. 18 is a schematic cross sectional view showing a step for forming nozzles in the printing head manufacturing procedure according to the modified second embodiment.

FIG. 18 shows a following step when a first nozzle 101 is formed by using an eximer laser processing apparatus, so as to extend from the bottom of the first recess 89 of the metal plate 62 through the polymer film 91 and the polyimide polymer film 109. Similarly, a second nozzle 111 is formed so as to extend from the bottom of the fourth recess 99 of the metal plate 62 through the polymer film 91 and the polyimide polymer film 109.

In the printer according to the present embodiment, the polymer film 91 is made from polyimide, and the polyimide polymer film 109 is made from polyimide polymer, both of which can be subjected to ablation processing using eximer laser. Consequently, the first nozzle 101 and the second nozzle 111 can be formed by ablation processing using eximer laser. Thus, in the printer of the present embodiment, the nozzle forming step is simplified, increasing the productivity.

Moreover, since these polyimide polymers have an excellent processability by ablation using eximer laser, the first nozzle 101 and the second nozzle 111 can be formed without burrs or peeling-out, which may cause defective products. Thus, the production yield is increased. This also promises a preferable productivity.

Subsequently, as has been described above, a diaphragm, an ink supply tube, and piezoelectric devices are arranged, completing the printing head.

Thus, in the printer according to the present embodiment, a liquid-repellent polyimide polymer is used at least around the nozzle openings on the nozzle opening plane of the printing head. This assures the liquid repellence around the nozzle opening portions. That is, in the wait state when ink is not to be mixed with diluent, ink is sure to be separated from the diluent, which enables to accurately control ink-diluent mixing ratio for each dot. This in turn assures an accurate gradation expression in accordance with an image data and to form a recorded image of a high resolution.

Furthermore, ink and diluent discharging stability is also assured, enabling to obtain a recorded image of a high quality.

Moreover, because the aforementioned polyimide polymer is an adequate material for ablation processing using eximer laser, in the printer according to the present embodiment, it is possible to use eximer laser for ablation so as to form nozzles. This simplifies the manufacturing procedure, increasing the productivity.

Furthermore, in the printer according to the present embodiment, except for the portion to form a nozzle of the printing head, i.e., except for the portion made of polyimide polymer for forming the nozzles of the printing head, the material used is polysulfone or polyethersulfone, and the polyimide polymer having the coefficient of water absorption as 1.0 (%) or above when dipped in 23 (°C.) water for 24 hours. These materials can be subjected to ablation processing using eximer laser, so as to form nozzles. This simplifies the production procedure and increases the productivity.

Moreover, since these materials have an excellent property when subjected to ablation processing using eximer laser, the nozzles can be formed without causing burrs or peeling-out. This increases the production yield. Accordingly, the printer according to the present invention can be said to have a preferable productivity.

In order to confirm the effects of the present invention, following experiments were carried out. That is, various polyimide polymers were prepared and their coefficients of water absorption and surface tensions were determined. As the polyimide polymer, four samples were used: Sample 1 is Capton 500 V (trade name) produced by Toray-Du Pont Co., Ltd; Sample 2 is Neoflex PI-A (trade name) produced by Mitsui Toatsu Co., Ltd.; Sample 3 is Yupicoat FS-100 L (trade name) produced by Ube Kosan Co., Ltd; and Sample 4 is Yupifine FP-100 (trade name) produced by Ube Kosan Co., Ltd.

These Samples 1 to 4 were dipped in water of 23 (°C.) for 24 hours to determine their coefficients of water absorption and, by using a wetness indicator chemical, the lowest surface tensions which can be repelled.

That is, if a material has a surface tension smaller than the surface tension of the ink or diluent, the material can repel the ink or the diluent.

The results obtained are as follows: Sample 1 has the coefficient of water absorption as 3.0 (%) and surface tension as 54 (dyn/cm) or above; Sample 2 has the coefficient of water absorption as 0.8 (%) and the surface tension as 38 (dyn/cm); Sample 3 has the coefficient of water absorption as 0.3 (%) and the surface tension as 31 (dyn/cm) or below; and Sample 4 has the coefficient of water absorption as 0.3 (%) and the surface tension as 31 (dyn/cm) or below.

As can be understood from these results, the polyimide material reduces its surface tension and increases liquid repellence as the coefficient of water absorption decreases.

Moreover, the ink and the diluent normally have a surface tension as 30 (dyn/cm) to 40 (dyn/cm). Consequently, it is considered that a significantly high liquid repellence can be obtained by arranging a polyimide polymer having a surface tension as 30 (dyn/cm) at least around the nozzle openings on the nozzle opening side of the printing head. That is, by using a polyimide polymer having a coefficient of water absorption as 0.4 (%) or below, it is possible to obtain a significantly high liquid repellence around the nozzle openings.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A printer comprising:

a printing head comprising a pressure chamber into which a discharge medium is introduced, the printer head further comprising a nozzle forming member, the nozzle forming member comprising a surface layer in which a nozzle is formed, and a substrate disposed in which a pressure chamber is formed, the surface layer overlying the substrate, the nozzle being in fluid communication with the pressure chamber, the discharge medium being discharged through a nozzle opening disposed in the surface layer, the pressure chamber being defined by a recess disposed in the substrate, a diaphragm being connected to the substrate opposite the surface layer so that the diaphragm covers the recess, the pressure chamber extending between the nozzle and a discharge supply passage, the discharge supply passage being disposed between a discharge supply port and the pressure chamber, the discharge supply port being narrower than the pressure chamber thereby limiting backflow from the pressure chamber through the discharge supply passage and to the discharge supply port, the nozzle being narrower than the pressure chamber, the surface layer being disposed around the nozzle opening and comprising a polyimide polymer having the following formula:

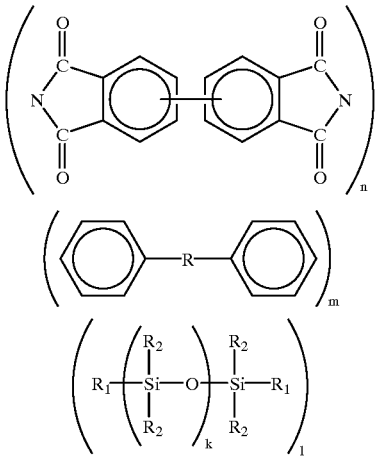

wherein k, l, m and n are integers, the substrate comprising a material selected from the group consisting of polysulfane and polyethersulfane.

2. The printer of claim 1 wherein the polyimide polymer of the surface layer has a coefficient of water absorption of 0.4% or less when dipped in water having a temperature of 23° C. for 24 hours.

3. The printer of claim 1 wherein the polyimide polymer of the surface layer is polymerized at a temperature of 180° C. or less.

4. The printer of claim 1 wherein the polyimide polymer of the surface layer comprises polyimide siloxane.

5. The printer of claim 1 wherein one of the layers of the nozzle other than the surface layer, comprises polyimide polymer having a coefficient of water absorption of 1.0% or higher when dipped in water having a temperature of 23° C. for 24 hours.

6. The printer of claim 1 wherein the nozzle is formed by an ablation processing utilizing excimer laser.

7. The printer of claim 1 wherein the discharge medium has a surface tension and the surface layer of the nozzle forming member has a surface tension smaller than a surface tension of the discharge medium.

8. The printer of claim 7 wherein the surface layer of the nozzle forming member has a surface tension of 31 dyn/cm or below.

9. A printer comprising:

a printing head comprising a first pressure chamber into which a discharge medium is introduced;

a second pressure chamber into which a quantitative medium is introduced;

a nozzle forming member comprising a surface layer in which a first nozzle and a second nozzle are formed and a substrate in which the first and second pressure chambers are formed, the surface layer overlying the substrate, the first nozzle being in fluid communication with the first pressure chamber, the second nozzle being in fluid communication with the second pressure chamber;

the first nozzle comprising a first nozzle opening, the second nozzle comprising a second nozzle opening, the first and second nozzle openings being arranged adjacent to each other, the second nozzle being directed towards the first nozzle so that the quantitative medium seeps from the second nozzle opening towards the first nozzle opening so as to mix the quantitative medium with the discharge medium as the discharge medium seeps from the first nozzle, the first pressure chamber being defined by a first recess disposed in the substrate and a diaphragm, the first pressure chamber extending between the first nozzle and a discharge supply passage, the discharge supply passage being disposed between a discharge supply port and the first pressure chamber, the discharge supply passage being narrower than the first pressure chamber thereby limiting backflow from the first pressure chamber through the discharge supply passage and to the discharge supply port, the first nozzle being narrower than the first pressure chamber, the second pressure chamber being defined by a second recess disposed in the substrate and the diaphragm, the second pressure chamber extending between the second nozzle and a quantitative medium supply passage, the quantitative medium supply passage being disposed between a quantitative medium supply port and the second pressure chamber, the quantitative medium supply port being narrower than the second pressure chamber thereby limiting backflow from the second pressure chamber through the quantitative medium supply passage and to the quantitative medium supply port, the second nozzle being narrower than the second pressure chamber, the diaphragm being connected to the substrate opposite the surface layer so that the diaphragm covers the first and second recesses, the surface layer comprising polyimide polymer having the formula:

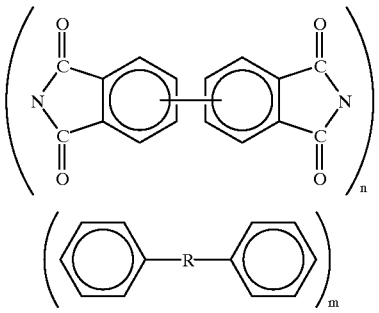

-continued

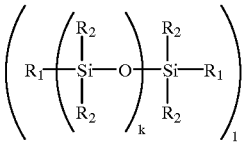

wherein k, l, m and n are integers, the surface layer extending around the first and second nozzle openings, the substrate comprising a material selected from the group consisting of polysulfane and polyethersulfane.

10. The printer of claim 9 wherein the polyimide polymer has a coefficient of water absorption of 0.4% or less when dipped in water having a temperature of 23° C. for 24 hours.

11. The printer of claim 9 wherein the polyimide polymer of the surface layer is polymerized at a temperature of 180° C. or less.

12. The printer of claim 9 wherein the polyimide polymer of the surface layer comprises polyimide siloxane.

13. The printer of claim 10 wherein one of the layers of the nozzle forming member, other than the surface layer, comprises polysulfone.

14. The printer of claim 9 wherein the nozzle is formed by an ablation processing utilizing excimer laser.

15. The printer of claim 9 wherein the discharge medium has a surface tension and the surface layer of the nozzle forming member has a surface tension smaller than a surface tension of the discharge medium.

16. The printer of claim 15 wherein the surface layer of the nozzle forming member has a surface tension of 31 dyn/cm or below.

17. The printer of claim 9 wherein the polyimide polymer comprises a polyimide siloxane having the formula:

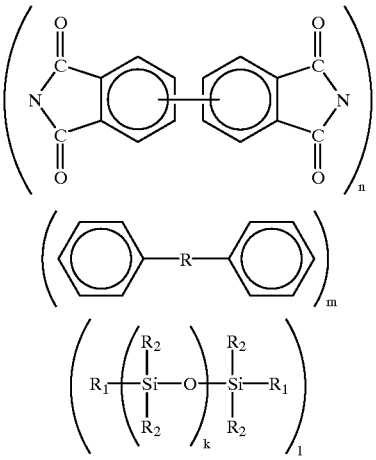

wherein k, l, m and n are integers.

* * * * *